United States Patent [19]

Domian et al.

[11] Patent Number: 4,840,768

[45] Date of Patent: Jun. 20, 1989

[54] AUSTENITIC FE-CR-NI ALLOY DESIGNED FOR OIL COUNTRY TUBULAR PRODUCTS

[75] Inventors: Henry A. Domian; Dale F. LaCount, both of Alliance; Alex S. Miller, Poland, all of Ohio; Kenneth D. Seibert, Hemet, Calif.

[73] Assignee: The Babcock & Wilcox Company, New Orleans, La.

[21] Appl. No.: 270,142

[22] Filed: Nov. 14, 1988

[51] Int. Cl.[4] ..... C22C 30/02

[52] U.S. Cl. ..... 420/582; 420/586

[58] Field of Search ..... 420/582, 586.1

[56] References Cited

U.S. PATENT DOCUMENTS

| | | | |
|---|---|---|---|
| 4,385,933 | 5/1983 | Ehrlich et al. | 420/53 |
| 4,400,209 | 8/1983 | Kudo et al. | 420/451 |
| 4,400,210 | 8/1983 | Kudo et al. | 420/443 |
| 4,400,211 | 8/1983 | Kudo et al. | 420/451 |
| 4,400,349 | 8/1983 | Kudo et al. | 420/443 |
| 4,409,025 | 11/1982 | Sugitani et al. | 420/584 |
| 4,421,557 | 12/1983 | Rossomme et al. | 420/40 |
| 4,421,571 | 12/1983 | Kudo et al. | 420/452 |
| 4,444,589 | 4/1984 | Sugitani et al. | 420/584 |
| 4,489,040 | 12/1984 | Asphahani et al. | 420/582 |
| 4,505,232 | 3/1985 | Usami et al. | 420/50 |
| 4,530,720 | 7/1985 | Moroishi et al. | 420/584 |

*Primary Examiner*—L. Dewayne Rutledge
*Assistant Examiner*—David Schumaker
*Attorney, Agent, or Firm*—Vytas R. Matas; Robert J. Edwards; Daniel S. Kalka

[57] ABSTRACT

An austenitic alloy has high strength and corrosion resistance and includes from 27 to 32 weight percent nickel and 24 to 28 weight percent chromium. Up to 2.75 weight percent silicon, 3 weight percent copper and molybdenum and 2 weight percent manganese are included for contributing to the characteristics to the alloy rendering the alloy particularly useful for fabricating oil well tubular products. Only very low components of nitrogen, carbon, phosphorus and sulfur are included.

3 Claims, No Drawings

AUSTENITIC FE-CR-NI ALLOY DESIGNED FOR OIL COUNTRY TUBULAR PRODUCTS

FIELD AND BACKGROUND OF THE INVENTION

The present invention relates, in general, to high strength corrosion resistant alloys, and, in particular, to a new and useful austenitic alloy containing critical amounts of nickel, chromium, silicon, copper, molybdenum and manganese, with iron and incidental impurities.

The need for a high strength and corrosion resistant alloy that will retain its integrity in the hostile environment of deep oil sour wells, has become apparent with the decrease of easily obtained sweet oil reserves. Since sour wells can contain significant amounts of hydrogen sulfide, carbon dioxide, and chloride solutions at high temperatures and pressures, alloys with better resistance to failure under stress and corrosive conditions would be desirable.

To minimize corrosion, various high alloy stainless steels and nickel alloys are now being used for other applications. Some disadvantages with most of these alloys have been, however, the relatively high cost because of the increased alloying content, relatively complicated manufacturing, and the fact that these alloys are still subject to stress corrosion cracking. Many metalurgical factors influence the mechanical and corrosion behavior of these alloys. These factors include microstructure, composition, and strength. All of these factors are interrelated and must be closely controlled or optimized with respect to sour well applications.

U.S. Pat. Nos. 4,400,209; 4,400,210; 4,400,211; 4,400,349; and 4,421,571, all to Kudo et al, disclose high strength alloys which are particularly useful for deep well casing, tubing and drill pipes, and which utilize compositions including nickel, chromium, manganese and molybdenum. These patents also rely on tungsten additions that satisfies a specific relationship with the presence of chromium and molybdenum to make up a significant proportion of the alloy as a whole.

U.S. Pat. No. 4,489,040 to Asphahani et al, also discloses a corrosion resistant alloy including nickel and chromium plus tungsten.

Titanium is also utilized as an additive for corrosion resistant nickel-chromium alloys as disclosed in U.S. Pat. Nos. 4,409,025 and 4,419,129 to Sugitani et al, and U.S. Pat. No. 4,385,933 to Ehrlich et al.

Niobium is an additive for corrosion resistant alloys as disclosed by U.S. Pat. No. 4,505,232 to Usami et al, U.S. Pat. No. 4,487,744 to DeBold et al, and U.S. Pat. No. 4,444,589 to Sugitani et al.

An oxidation resistant austenitic steel advocating relatively low chromium and nickel contents is disclosed by U.S. Pat. No. 4,530,720 to Moroishi et al.

Lanthanum can be an additive for austenitic stainless steel as disclosed by U.S. Pat. No. 4,421,557 to Rossomme et al.

As evidenced by several of the foregoing reference which include relatively high chromium contents, the presence of nitrogen is desireable. Nitrogen additions is used in some alloys to replace chromium for maintaining a stable austenitic structure. Chromium normally exists in the ferritic form.

SUMMARY OF THE INVENTION

It is a principle object of the present invention to provide a fully austenitic alloy having a combination of chemical elements whose synergistic effect gives it a highly desireable combination of mechanical and corrosion resistant properties. Since the alloy of the present invention is intended primarily for use in oil tubular products, cost is an important consideration. Accordingly, another object of the present invention is to provide an alloy that achieves a good combination of high strength, ductility, corrosion resistance under stress and metallurgical stability, while being cost effective.

The invention provides an alloy that is easily fabricated either hot or cold. The high strength alloy has excellent resistance to stress corrosion cracking under test conditions equivalent to or more severe than conditions than the alloy would experience in use. The alloy also has improved pitting and galling resistance. For cost effectiveness, the most expensive elements, especially nickel, are reduced to relatively low levels, without however sacrificing the desirable characteristics of the alloy.

According to the invention thus, an austenitic alloy having high strength and corrosion resistance under stress, in particular for oil well tubular products, consists essentially of, in weight percent; 27–32 Ni; 24–28 Cr; 1.25–3.0 Cu; 1.0–3.0 Mo; 1.5–2.75 Si; 1.0–2.0 Mn; with no more than 0.015 N, 0.10 each of B, V and C, 0.30 A1, 0.03 P and 0.02 S; the balance being Fe and incidental impurities.

The alloy is substantially free of tungsten, titanium, niobium and lanthanum and uses substantially less nitrogen than is conventional in the prior art.

Comparative screening tests were conducted on 46 different alloys in discovering the foregoing critical combination of components. Among the alloys tested was a commercial alloy identified as Alloy 825 which contains 38 to 46 weight percent nickel, rendering the alloy of the present invention about 17% cheaper to manufacture. The alloy of the present invention performed substantially as well as, and in some instances, better than alloy 825.

Other alloys tested were inadequate in other various ways. If the content of manganese, for example was too low or too high, forging of the alloy became very difficult. This was particularly true when the alloys were made by electroslag remelting (ESR).

DESCRIPTION OF THE PREFERRED EMBODIMENT

The alloy of the present invention which was derived by computer design and was one of many alloys tested, reached the objectives cited above for a high strength corrosion resistant alloy.

Table 1 shows the composition, in weight percent, of a laboratory sample of the invention as well as preferred and allowable ranges for each of the components of the alloy.

TABLE 1

| COMPOSITION IN WEIGHT PERCENT | | | |
|---|---|---|---|
| | Laboratory Sample | Preferred Range | Allowable Range |
| C | 0.01 | .01–.03 | .10 Max. |
| Mn | 1.42 | 1.25–1.75 | 1.0–2.0 |
| Si | 2.20 | 1.75–2.25 | 1.5–2.75 |
| P | 0.009 | .02 Max. | .03 Max. |
| S | 0.004 | .009 Max. | .02 Max. |

TABLE 1-continued

| COMPOSITION IN WEIGHT PERCENT | | | |
|---|---|---|---|
| | Laboratory Sample | Preferred Range | Allowable Range |
| Cr | 25.3 | 25.5–26.5 | 24–28 |
| Ni | 30.3 | 29.5–30.5 | 27–32 |
| Mo | 1.53 | 1.4–1.6 | 1.0–3.0 |
| Cu | 1.88 | 1.75–2.25 | 1.25–3.0 |
| Al | 0.17 | .05 Max. | .30 Max. |
| B (less than) | 0.001 | — | .10 Max. |
| V | 0.014 | — | .10 Max. |
| N | 0.0053 | .006 Max. | .015 Max. |
| O ppm | 53 | — | — |

Since the alloy of the present invention is austenitic, and even though carbon and nitrogen are powerful austenite stabilizers, neither carbon nor nitrogen is essential in the composition. Nickel insures the austenitic balance of the alloy and its desired properties, particularly hot workability and corrosion resistance. Higher nickel adds to the cost of the alloy without correspondingly contributing to its usefulness. The added cost is thereby unwarranted. Advantageously, no more than 30.5 weight percent nickel is needed. This is contrasted to Alloy 825 which contains 38 to 40 percent weight nickel. Chromium at about 25.3 weight percent is the primary additive for rendering the alloy corrosion resistant. Higher chromium content risks the precipitation of ferrite and sigma-phase.

Phosphorus and sulfur are purposely kept low to avoid the undesireable effects these components have upon corrosion resistance or forgeability. Silicon is provided to enhance resistance to stress corrosion cracking. Copper is believed to contribute to corrosion resistance as well, particularly in acid environments. Like nickel, copper works to stabilize the austenitic balance. Molybdenum is incorporated so as to improve general corrosion and pitting resistance. Manganese, at the levels provided, improves workability at high temperatures and is useful in obtaining a proper structure in the alloy.

The following tests were conducted to verify the advantageous properties of the alloy.

A 20 lb. ingot was cast from the alloy described in Table 1. The alloy was prepared by vacuum induction melting. After soaking at 2200° F. for 1 hour, the ingot was forged between 1800°–2050° F. into 0.920" diameter bars. The bars were cold swagged down to 43 and 72 percent reductions. The room temperature tensile properties were then measured in the cold worked condition.

The results of these measurements are set forth in Table 2.

TABLE 2

| 0.2% Y.S. | | UTS | | Elongation | Reduction of Area | Cold Reduction |
|---|---|---|---|---|---|---|
| ksi | (MPa) | ksi | (MPa) | (%) | (%) | (%) |
| 124.0 | (854) | 133.6 | (921) | 21.2 | 74.6 | 43 |
| 140.6 | (969) | 149.3 | (1029) | 18.1 | 71.2 | 72 |

The alloy of the present invention is characterized by a unique combination of resistance to corrosive media. Samples cut from the swagged bars were machined into 0.200" diameter smooth tensile specimens and stress corrosion tested. Test results are given in Table 3.

TABLE 3

| Test Environment | Material[3] Condition | Yield Strength ksi | Yield Strength (MPa)[1] | Test Stress ksi | Test Stress (MPa) | Time To Failure (hours)[2] |
|---|---|---|---|---|---|---|
| | | $MgCl_2$ Test: | | | | |
| Boiling 42% $MgCl_2$ (310° F.) | 43% CW | 124.6 | (854) | 111.7 | (776) | 1000 NF |
| Boiling 42% $MgCl_2$ (310° F.) | 72% CW | 140.6 | (969) | 112.5 | (775) | 1000 NF |
| | | Autoclave Test: | | | | |
| 25% NaCl - 10% $H_2S$ 90% $CO_2$, 1000 psig @ 500° F. | 43% CW | 124.0 | (854) | 111.7 | (770) | 720 NF |

[1]Longitudinal Tests Y.S. is Stress For 0.2% Offset
[2]NF — No Failure in Hours Shown
[3]CW — Cold Worked by Swagging.

Aside from having excellent stress corrosion resistance, this alloy has improved resistance to pitting in chloride environments (5% $FeCl_3$–10% NaCl (75° F.) solutions) and significantly improved galling resistance compared to similar tests performed on Alloy 825.

The alloy of the present invention is primarily intended for use in high strength tubulars and the like when cold worked. The inventive alloy is significantly better in hot workability, cold formability, resistance to stress corrosion cracking, especially in $MgCl_2$ solutions, and shows improved pitting and galling resistance compared with other more expensive high alloys, such as Alloy 825. The alloy of the present invention while developed primarily for tubing can also be used in other shapes.

Some of the alloys which were prepared for comparison have compositions shown in Table 4.

Table 5 shows a summary of a galling test that was conducted on some of the alloys as well as some commercially available alloys. The invention is included for comparison. Table 6 shows tensile properties of some of the alloys, including four tests conducted with the inventive alloy.

TABLE 4

| Alloy No. | C | Mn | P | S | Si | Cr | Wi | Mo | Cu | Al | Ti | B | H | V | O ppm |
|---|---|---|---|---|---|---|---|---|---|---|---|---|---|---|---|
| 1 | .012 | 1.54 | .011 | .003 | .31 | 24.69 | 30.39 | 2.02 | 1.82 | <.05 | .10 | <.005 | .040 | .035 | — |
| 2 | .010 | 1.60 | .012 | .003 | .34 | 25.69 | 30.33 | 2.00 | 1.77 | <.05 | .11 | <.005 | .033 | .036 | — |
| 3 | .010 | 1.76 | .008 | .003 | .68 | 26.17 | 29.85 | 1.08 | 1.72 | <.05 | .10 | <.005 | .049 | .036 | — |
| 4 | .010 | 1.73 | .012 | .003 | .78 | 27.85 | 30.50 | 1.09 | 1.81 | <.05 | .12 | <.005 | .039 | .039 | — |
| 5 | .010 | 1.18 | .010 | .003 | 1.29 | 26.60 | 31.66 | .36 | 1.84 | .027 | .022 | .0018 | .090 | — | — |
| 6 | .029 | 1.27 | .010 | .003 | 1.72 | 26.88 | 31.95 | .36 | 1.75 | .034 | .027 | .0014 | .090 | — | 430 |
| 7 | .014 | 1.38 | .010 | .002 | 1.99 | 28.73 | 29.65 | <.05 | 1.87 | .025 | .021 | <.001 | .12 | — | — |
| 8 | .017 | 1.30 | .010 | .002 | 2.11 | 29.34 | 31.23 | <.05 | 1.89 | .045 | .027 | <.001 | .11 | — | 120 |
| 9 | .010 | 7.96 | .011 | .008 | 1.30 | 29.86 | 17.68 | 1.93 | 1.82 | <.005 | — | .005 | .58 | — | 73 |
| 10 | .010 | 6.87 | .014 | .007 | .67 | 23.39 | 16.39 | 1.74 | 2.31 | <.006 | — | .005 | .51 | — | 400 |
| 11 | .021 | 5.25 | .020 | .006 | 1.90 | 28.26 | 20.39 | 1.86 | 1.73 | <.01 | — | .004 | .60 | — | 74 |

TABLE 4-continued

| Alloy No. | C | Mn | P | S | Si | Cr | Wi | Mo | Cu | Al | Ti | B | H | V | O ppm |
|---|---|---|---|---|---|---|---|---|---|---|---|---|---|---|---|
| 12 | .010 | .43 | .014 | .003 | .33 | 18.38 | 45.70 | 3.16 | 2.07 | .73 | 2.50 | .005 | .022 | — | 340 |
| 13 | .012 | .62 | .013 | .002 | .42 | 16.65 | 48.00 | 5.61 | 1.83 | 1.0 | 2.55 | .008 | .0092 | — | 57 |
| 14 | .012 | .60 | .010 | .002 | .38 | 19.31 | 48.00 | 3.75 | 1.83 | .81 | 2.95 | .008 | .010 | — | 89 |
| 15 | .013 | .40 | .011 | .003 | .32 | 17.06 | 47.80 | 5.61 | 1.85 | .82 | 2.68 | .004 | .0089 | — | 61 |
| 16 | .010 | 3.69 | .005 | .004 | .59 | 13.44 | 40.96 | 5.94 | 4.76 | 1.0 | 2.65 | .007 | .010 | — | 67 |
| 17 | <.01 | .55 | .013 | .003 | .33 | 25.07 | 35.87 | 1.15 | 1.84 | .52 | 1.01 | .003 | .027 | — | 80 |
| | .010 | .77 | .012 | .001 | .35 | 27.94 | 34.28 | 1.00 | 1.77 | .47 | 1.09 | .003 | .021 | — | 63 |
| 18 | .013 | .54 | .012 | .002 | .18 | 28.68 | 36.20 | <.05 | 1.85 | .53 | 1.05 | .003 | .032 | — | 91 |
| 19 | .012 | .50 | .013 | .003 | .22 | 23.85 | 41.00 | 1.11 | 1.94 | .75 | 1.28 | .001 | .024 | — | 120 |
| 20 | .021 | .47 | .012 | .002 | .13 | 27.37 | 40.68 | .054 | 1.92 | .67 | 1.28 | .002 | .027 | — | 90 |
| 21 | .013 | 2.59 | .011 | .002 | .78 | 24.11 | 34.97 | 1.83 | 1.85 | .48 | 091 | .005 | .025 | — | — |
| 22 | .020 | 1.63 | .014 | .007 | 2.01 | 28.44 | 29.73 | .56 | 2.67 | <.05 | <.01 | .004 | .66 | .037 | 390 |
| 23 | .019 | 1.48 | .026 | .004 | 2.49 | 28.14 | 29.68 | .97 | 2.76 | <.01 | <.01 | .003 | .52 | .048 | 220 |
| 24 | .024 | 1.51 | .019 | .005 | 2.07 | 29.76 | 31.34 | 1.47 | 2.79 | <.005 | <.01 | .0042 | .27 | .042 | 170 |
| 25 | .047 | 1.40 | .017 | .005 | 3.01 | 30.32 | 31.30 | .66 | 2.89 | <.05 | <.05 | .005 | .53 | .052 | 230 |
| 26 | .022 | 1.47 | .028 | .003 | 3.15 | 27.71 | 29.39 | .96 | 2.73 | <.01 | <.01 | .004 | .49 | .050 | 170 |
| 27 | .022 | 1.57 | .019 | .006 | 2.85 | 30.17 | 31.41 | 1.48 | 2.82 | <.005 | <.01 | .0034 | .22 | .042 | 180 |
| 28 | .017 | 1.04 | .017 | .005 | 3.60 | 29.96 | 31.40 | .71 | 2.86 | <.05 | <.05 | .004 | .53 | .050 | 280 |
| 29 | .018 | 1.43 | .024 | .006 | 3.68 | 28.16 | 30.44 | 1.01 | 2.82 | <.01 | <.01 | .001 | .42 | .048 | 220 |
| 30 | .020 | 1.55 | .020 | .007 | 3.32 | 30.02 | 32.12 | 1.53 | 2.96 | <.005 | <.01 | .0025 | .25 | .043 | 170 |
| 31 | .023 | 2.99 | .020 | .006 | 2.95 | 30.89 | 32.91 | 1.06 | 2.86 | <.005 | <.01 | .0024 | .37 | .047 | 170 |
| 32 | .021 | 4.61 | .018 | .004 | 3.30 | 37.96 | 30.52 | 1.11 | 2.94 | <.005 | <.01 | .003 | .38 | .045 | 230 |
| 33 (Alloy 7) | .013 | 1.49 | .012 | .005 | 2.00 | 29.37 | 29.50 | <.05 | 1.75 | <.05 | <.05 | .002 | .17 | .046 | 200 |
| 34 (825) | .020 | .57 | .019 | .003 | .23 | 22.62 | 41.45 | 2.71 | 2.26 | .066 | 1.23 | .003 | .006 | .045 | 80 |
| INVEN-TION | <.01 | 1.42 | .009 | .004 | 2.20 | 25.27 | 30.31 | 1.53 | 1.88 | .17 | — | <.001 | .0053 | .014 | 53 |

TABLE 5

Summary of Galling Test Results[1]

| Alloy Number | Yield Strength ksi(*) | Hardness ($HR_A$) | Threshold Lower Galling Load (lbs) | Threshold Maximum Burnishing Load (lbs) | Threshold Lower Galling Stress (ksi) | Threshold Maximum Burnishing Stress (ksi) | Threshold Lower Galling (% of Y.S.) | Threshold Maximum Burnishing (% of Y.S.) |
|---|---|---|---|---|---|---|---|---|
| 1 | 124.3(T) | 63.6 | 2740 | 3790 | 20.6 | 28.5 | 16.6 | 22.9 |
| 2 | 123.4(T) | 63.9 | 1230 | 1430 | 9.2 | 10.7 | 7.5 | 8.7 |
| 3 | 119.2(T) | 63.6 | 1280 | 1410 | 9.6 | 10.6 | 8.1 | 8.9 |
| 4 | 121.7(T) | 63.3 | 1020 | 1100 | 7.7 | 8.3 | 6.3 | 6.8 |
| 5 | 130.0(T) | 64.7 | 1150 | 2300 | 10.1 | 17.3 | 7.8 | 13.3 |
| 6 | 131.9(T) | 65.2 | 3790 | 5770 | 28.5 | 43.4 | 21.6 | 32.9 |
| 7 | 130.9(T) | 65.9 | 3990 | 6770 | 30.0 | 50.9 | 22.9 | 38.9 |
| 8 | 135.2(T) | 65.9 | 2190 | 4980 | 16.5 | 37.4 | 12.2 | 27.7 |
| 11 | 129.7(T) | 68.0 | 3480 | 7950 | 26.2 | 59.8 | 20.2 | 46.1 |
| 11 | 134.3(L) | 68.0 | 3480 | 7970 | 26.2 | 60.0 | 19.5 | 44.6 |
| 12 | 116.7(T) | 68.4 | 2480 | 7960 | 18.7 | 60.0 | 16.0 | 51.3 |
| 12 | 117.1(L) | 68.4 | 2490 | 7970 | 18.7 | 60.0 | 16.0 | 51.2 |
| 15 | 143.1(T) | 70.8 | 2610 | 3980 | 19.6 | 29.9 | 13.7 | 20.9 |
| 15 | 123.5(L) | 70.8 | 2610 | 3990 | 19.6 | 30.0 | 15.9 | 24.3 |
| 17 | 129.1(T) | 66.8 | 2250 | 2990 | 16.9 | 22.5 | 13.1 | 17.4 |
| INVENTION | 125.0(L) | 63.8 | 2160 | 4790 | 16.3 | 36.0 | 13.0 | 28.8 |
| Sanicro 28 | 101.3(T) | 65.7 | 2380 | 4280 | 17.9 | 32.2 | 17.7 | 31.8 |
| Sanicro 28 | 127.1(L) | 65.7 | 2380 | 4280 | 17.9 | 32.2 | 14.1 | 25.3 |
| Alloy 825 | 115.6(T) | 65.5 | 1200 | 1590 | 9.0 | 12.0 | 7.6 | 10.1 |
| Alloy 825 | 135.8(L) | 65.5 | 1200 | 1590 | 9.0 | 12.0 | 6.5 | 8.6 |

[1]Tests were performed at Hydril Mechanical Products Division, Houston, Texas. Each alloy was run against each other to determine the threshold values.
*T - Transverse
L - Longitudinal

TABLE 6

Tensile Properties and Hardness Data

| Alloy No. | 0.2% Yield Strength ($10^3$ psi) | Ult. Ten. Strength ($10^3$ psi) | Elongation (% in 2 inches) | Red. of Area (%) | Hardness ($R_A$) | Amount of Cold Reduction (%) | Test Direction | Working Process |
|---|---|---|---|---|---|---|---|---|
| 24 | 177.8 | 186.8 | 7.4 | 42.8 | 67.3 | 43.7 | Longitudinal | Swagged |
| 24 | 132.8 | 148.3 | 24.9 | 64.2 | 65.4 | 27.6 | Longitudinal | Swagged |
| 24 | 153.1 | 156.2 | 20.6 | 62.8 | 66.4 | 32.7 | Longitudinal | Swagged |
| 31 | 177.5 | 184.1 | 5.5 | 27.0 | 68.2 | 41.1 | Longitudinal | Swagged |
| 31 | 146.1 | 157.4 | 16.9 | 40.9 | 66.7 | 24.5 | Longitudinal | Swagged |
| 33 | 172.2 | 176.3 | 5.0 | 24.8 | 67.5 | 43.7 | Longitudinal | Swagged |
| 33 | 158.8 | 165.2 | 12.6 | 59.1 | 65.5 | 33.7 | Longitudinal | Swagged |
| 33 | 153.2 | 160.8 | 14.4 | 63.7 | 67.5 | 40.0 | Longitudinal | Swagged |
| 33 | 172.6 | 176.4 | 10.8 | 41.0 | | | Longitudinal | Swagged |
| 33 | 103.0 | 129.5 | 38.4 | 68.8 | | | Longitudinal | Swagged |
| 32 | 133.5 | 144.5 | 20.0 | 66.0 | | 32.0 | Longitudinal | Swagged |
| 34 | 157.9 | 164.6 | 13.8 | 62.6 | 65.7 | 67.2 | Longitudinal | Swagged |
| 34 | 150.9 | 153.4 | 15.0 | 63.3 | | | Longitudinal | Swagged |

TABLE 6-continued

| Alloy No. | 0.2% Yield Strength ($10^3$ psi) | Ult. Ten. Strength ($10^3$ psi) | Elongation (% in 2 inches) | Red. of Area (%) | Hardness ($R_A$) | Amount of Cold Reduction (%) | Test Direction | Working Process |
|---|---|---|---|---|---|---|---|---|
| | Tensile Properties and Hardness Data | | | | | | | |
| 34 INVEN-TION | 137.4 | 140.2 | 19.6 | 69.9 | | | Longitudinal | Swagged |
| | 140.6 | 149.3 | 18.1 | 71.2 | 65.2 | 74.3 | Longitudinal | Swagged |
| | 124.1 | 133.6 | 21.2 | 74.6 | | 40.0 | Longitudinal | Swagged |
| | 125.0 | 132.5 | 18.1 | 65.8 | 63.8 | 47.2 | Longitudinal | Cold Rolled Plate |
| | 133.0 | 152.0 | 12.5 | 47.4 | 64.8 | 61.0 | Transverse | Cold Rolled Plate |

The invention claimed is:

1. An austenitic alloy having high strength galling resistance, and corrosion resistance under stress consisting essentially of, in weight percent; 27–32 Ni; 24–28 Cr; 1.25–3.0 Cu; 1.0–3.0 Mo; 1.5–2.75 Si; 1.0–2.0 Mn; with no more than 0.015 N, 0.10 each of B, V and C, 0.30 A1, 0.03 P and 0.02 S; the balance being Fe and incidental impurities.

2. The alloy of claim 1 consisting essentially of 29.5–30.5 Ni, 25.5–26.5 Cr, 1.75–2.25 Cu, 1.4–1.6 Mo, 1.75–2.25 Si, 1.25–1.75 Mn, with no more than 0.006 N, 0.009 S and 0.02 P.

3. The alloy according to claim 2 including, as incidental impurity, 53 parts per million oxygen.

* * * * *